US008978553B2

(12) United States Patent
Utsumi et al.

(10) Patent No.: US 8,978,553 B2
(45) Date of Patent: Mar. 17, 2015

(54) HEAT-SENSITIVE LITHOGRAPHIC PRINTING PLATES

(75) Inventors: Masao Utsumi, Tokyo (JP); Yoshihito Ohashi, Tokyo (JP); Kouichi Agata, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 1330 days.

(21) Appl. No.: 12/745,209

(22) PCT Filed: Dec. 12, 2008

(86) PCT No.: PCT/JP2008/072603
§ 371 (c)(1),
(2), (4) Date: May 27, 2010

(87) PCT Pub. No.: WO2009/078346
PCT Pub. Date: Jun. 25, 2009

(65) Prior Publication Data

US 2010/0307359 A1 Dec. 9, 2010

(30) Foreign Application Priority Data

Dec. 14, 2007 (JP) ..... 2007-323107
Mar. 24, 2008 (JP) ..... 2008-076751
Sep. 5, 2008 (JP) ..... 2008-227993

(51) Int. Cl.
*B41N 1/14* (2006.01)
*B41C 1/10* (2006.01)

(52) U.S. Cl.
CPC ..... *B41C 1/1041* (2013.01); *B41N 1/14* (2013.01)
USPC ..... 101/401.1

(58) Field of Classification Search
CPC ..... B41N 1/14
USPC ..... 101/453, 454, 456, 457, 461, 462
See application file for complete search history.

(56) References Cited

U.S. PATENT DOCUMENTS

| | | | | |
|---|---|---|---|---|
| 4,531,140 | A * | 7/1985 | Suzuki et al. | 503/209 |
| 6,399,270 | B1 | 6/2002 | Mori et al. | |
| 6,420,083 | B1 | 7/2002 | Kawamura | |
| 2003/0207203 | A1* | 11/2003 | Tsuchimura et al. | 430/270.1 |
| 2004/0229163 | A1* | 11/2004 | Sonokawa et al. | 430/271.1 |

FOREIGN PATENT DOCUMENTS

| | | | |
|---|---|---|---|
| JP | 58-199153 | A | 11/1983 |
| JP | 59-174395 | A | 10/1984 |
| JP | 63-64747 | A | 3/1988 |
| JP | 2-115462 | U | 9/1990 |
| JP | 6-270572 | A | 9/1994 |
| JP | 7-25175 | A | 1/1995 |
| JP | 2000-190649 | A | 7/2000 |
| JP | 2000-301846 | A | 10/2000 |
| JP | 2004-237592 | A | 8/2004 |
| JP | 2006-272941 | A | 10/2006 |
| JP | 2007-237428 | A | 9/2007 |

* cited by examiner

*Primary Examiner* — Joshua D Zimmerman
(74) *Attorney, Agent, or Firm* — Birch, Stewart, Kolasch & Birch, LLP

(57) ABSTRACT

The present invention relates to a heat-sensitive lithographic printing plate requiring no on-press development or no water development, which provides clear printed image, has sufficient printing wear resistance, and has improved scumming, more specifically to a heat-sensitive lithographic printing plate comprising, on a water-resistant support, an image-forming layer containing a thermoplastic resin, a water-soluble polymer compound, and at least one selected from a compound of the following formulae (1), (2), (3) and (4). The present invention also relates to a direct heat-sensitive lithographic printing plate by which the generation of sticking phenomenon has been reduced.

13 Claims, No Drawings

HEAT-SENSITIVE LITHOGRAPHIC PRINTING PLATES

TECHNICAL FIELD

The present invention generally relates to a processless printing plate, more specifically, to a heat-sensitive lithographic printing plate capable of platemaking by thermal recording, which requires no on-press development treatment or simple development by washing, and generates no waste such as seen in ablation type.

BACKGROUND OF THE ART

According to recent developments of computers and peripheral equipments, platemaking methods of lithographic printing plates using various digital printers have been proposed. As such platemaking methods of lithographic printing plates, for example, platemaking methods using a xerographic laser printer for platemaking as described in JP-A-6-138719 and JP-A-6-250424, platemaking methods using on-demand ink-jet printer with thermofusible ink for platemaking as described in JP-A-9-58144, or platemaking methods using thermal printer with thermal transfer ink ribbon for platemaking as described in JP-A-63-166590, or the like, are known.

The platemaking methods using various digital printers as mentioned above have benefits capable of platemaking lithographic printing plate simply and easily because of requiring no limitation on safe light in handling and requiring no development treatment with a developer after image recording, unlike conventionally known platemaking methods of lithographic printing plates having a silver halide emulsion layer or platemaking methods of lithographic printing plates having a water retention layer surface coated with photosensitive resin. The printing plates used for platemaking system using digital printers are correctively referred to as a "processless printing plate".

However, all of the processless printing plates have problems as mentioned below, since a printing plate is formed by transferring an oil-sensitive (or lithographic printing ink-receivable) recording image to a support surface on which a water retention layer is provided.

1) Since the image forming layer is hydrophlic, the attachment of toner, ink and the like is insufficient. As a result, there are problems such as lack of transferred toner image density, and appearance of white spots in the transferred image.

2) Since the fixed status of the transferred image is insufficient, printing wear resistance is insufficient. As a result, there are problems such as loss of a part of small point character, small points in dotted image, in particular.

3) Due to that a small amount of toner is irregularly transferred to nonimage area, and thermal transfer ink ribbon is rubbed, there are problems such as occurrence of light scumming in whole.

As a method of obtaining lipophilic image area by providing an image-forming layer containing thermoplastic resin on a support without providing water retention layer on the support, and carrying out heat printing, known are a method of obtaining lipophilic image area by directly conducting thermal lithography with thermal head etc. without via thermal transfer ribbon to the image-forming layer, or a method of obtaining lipophilic image area by conducting thermal lithography with infrared laser etc.

As a direct heat-sensitive lithographic printing plate used for platemaking method in which thermal lithography is directly conducted using thermal head etc without via direct thermal transfer ribbon etc, known is a direct heat-sensitive lithographic printing plate having an image-forming layer containing water-soluble polymer compound and a thermofusible material as described in JP-A-58-199153 (Patent Literature 1), or JP-A-59-174395 (Patent Literature 2), or the like. On the other hand, as a heat-sensitive lithographic printing plate used for a method of obtaining lipophilic image area by thermal lithography with infrared laser etc, known is a heat-sensitive lithographic printing plate having an image-forming layer containing thermofusible particulars or thermoplastic polymer as described in JP-A-2000-190649 (Patent Literature 3), JP-A-2000-301846, (Patent Literature 4) and the like.

However, in general, such a heat-sensitive lithographic printing plate and a direct heat-sensitive lithographic printing plate have problems such as difficulty in obtaining clear printed image, insufficiency of printing wear resistance and a higher rate of occurrence of scumming since difference in hydrophlicity/lipophilicity between nonimage area and image area is insufficient. Besides, the direct heat-sensitive lithographic printing plates as described in Patent Literature 1, Patent Literature 2 and the like above have, in addition to the problems above, problems such as a higher rate of occurrence of so-called sticking phenomenon, that is, a phenomenon that thermofusible materials are cooled and fixed to thermal head during thermal lithography, since the printing plates are directly subject to thermal lithography using thermal head etc.

As a heat-sensitive lithographic printing plate capable of providing high image density, known is a heat-sensitive lithographic printing plate having an image-forming layer containing an inorganic pigment, a thermoplastic resin and a thermofusible material as described in JP-A-63-64747 (Patent Literature 5). Besides, in the above-mentioned Patent Literature 3 and Patent Literature 4, as a means for improving balance between lipophilicity of image area and hydrophlicity of nonimage area, a method of coating thermofusible fine particulars which exhibit lipophilicity with a material having specific thermal conductivity, and an idea of hydrophobizing hydrophilic group in hydrophlic polymer by utilizing chelate reaction with heat, are disclosed. However, based on the reasons that any of the reactions are hard to control, and difference in hydrophlicity/lipophilicity between nonimage area and image area is insufficient, they have problems such as difficulty in obtaining clear printed image, insufficient printing wear resistance and a higher rate of occurrence of scumming.

On the other hand, JP-A-6-270572 (Patent Literature 6) and JP-A-7-25175 (Patent Literature 7) disclose a direct heat-sensitive lithographic printing plate by which the generation of sticking phenomenon has been reduced by introducing thermoplastic materials which generates hydroxyl group by thermal decomposition. However, both printing plates have insufficient difference in lipophilicity of image area and hydrophlicity of nonimage area.

[Patent Literature 1] JP-A-58-199153
[Patent Literature 2] JP-A-59-174395
[Patent Literature 3] JP-A-2000-190649
[Patent Literature 4] JP-A-2000-301846
[Patent Literature 5] JP-A-63-64747
[Patent Literature 6] JP-A-6-270572
[Patent Literature 7] JP-A-7-25175

DISCLOSURE OF THE INVENTION

Problems to be Solved by the Invention

An object of the present invention is to provide a heat-sensitive lithographic printing plate requiring no on-press development or no water development, which provides clear printed image, has sufficient printing wear resistance, and has improved scumming. A further object of the present invention is to provide a direct heat-sensitive lithographic printing plate by which the generation of sticking phenomenon has been reduced.

Means for Solving the Problems

The problems above have been solved by the following means.

(1) A heat-sensitive lithographic printing plate comprising, on a water-resistant support, an image-forming layer containing a thermoplastic resin, a water-soluble polymer compound, and at least one selected from a compound of the following formulae (1), (2), (3) and (4).

Formula (1)

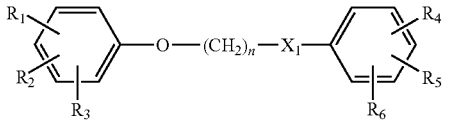

In the formula (1), $X_1$ is —O— or —CO—O—, $R_1$, $R_2$ and $R_3$ are each independently hydrogen atom, alkyl group or aryl group, or $R_1$, $R_2$ and $R_3$, taken together, form an aromatic ring, $R_4$, $R_5$ and $R_6$ are each independently hydrogen atom, alkyl group or aryl group, or $R_4$, $R_5$ and $R_6$, taken together, form an aromatic ring, n is an integer of 1 to 10.

Formula (2)

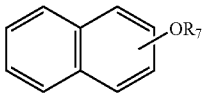

In the formula (2), $R_7$ is alkyl group, aryl group, alkylcarbonyl group, arylcarbonyl group, alkylsulfonyl group or arylsulfonyl group, and naphthalene ring in the formula (2) may have further substituents.

Formula (3)

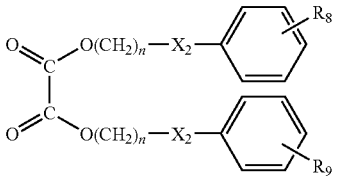

In the formula (3), $R_8$ and $R_9$ are each independently hydrogen atom, halogen atom, alkyl group having 1-4 carbon atoms or alkoxyl group having 1-4 carbon atoms, $X_2$ is a single bond or —O—, n is an integer of 1 to 4.

Formula (4)

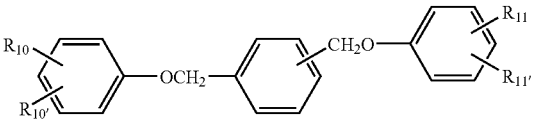

In the formula (4), $R_{10}$, $R_{10'}$, $R_{11}$ and $R_{11'}$ are each independently hydrogen atom, halogen atom, alkyl group, aryl group, alkoxy group, alkylcarbonyl group, arylcarbonyl group, alkoxycarbonyl group or aryloxy group.

(2) The heat-sensitive lithographic printing plate according to the above (1), wherein the image-forming layer does not substantially contain an inorganic pigment.

(3) The heat-sensitive lithographic printing plate according to the above (1) or (2), wherein the thermoplastic resin is a self-crosslinking type synthetic rubber latex.

(4) The heat-sensitive lithographic printing plate according to any one of the above (1) to (3), wherein the heat-sensitive lithographic printing plate is a direct heat-sensitive lithographic printing plate.

Effects of the Invention

According to the present invention, a heat-sensitive lithographic printing plate requiring no on-press development or no water development, which provides clear printed image, has sufficient printing wear resistance, and has improved scumming, can be provided. Further, a direct heat-sensitive lithographic printing plate by which the generation of sticking phenomenon has been reduced, can be provided. In addition, the heat-sensitive lithographic printing plate of the present invention is capable of platemaking by thermal recording, without generation of waste such as seen in ablation type.

BEST MODE FOR CARRYING OUT THE INVENTION

As used herein, the term "alkyl" denotes a saturated straight- or branched-chain hydrocarbon group, for example, methyl, ethyl, propyl, isopropyl, n-butyl, i-butyl, 2-butyl, t-butyl, penthyl, hexyl, decanyl and the like.

The term "alkoxy" denotes a group wherein the saturated straight- or branched-chain hydrocarbon group is as defined above and which is attached via an oxygen atom.

The term "halogen" denotes chlorine, iodine, fluorine and bromine.

The term "aryl" denotes a monovalent cyclic aromatic hydrocarbon radical consisting of one or two fused rings in which at least one ring is aromatic in nature, for example, phenyl, benzyl, naphthyl or biphenyl.

In the lithographic printing plate according to the present invention, the image-forming layer contains thermoplastic resin, water-soluble polymer compound, and at least one selected from a compound of the formulae (1), (2), (3) and (4), whereby the melting start temperature of the thermoplastic resin decreases when the surface of the image-forming layer is exposed to heat. This provides image area having excellent lipophilicity on the plate surface even with more less energy, so that clear printed image can be obtained, and the heat-sensitive lithographic printing plate of the present invention has sufficient printing wear resistance. As such, the compound of the formulae (1), (2), (3) and (4) of the present invention is extremely effective for providing heat-sensitive lithographic printing plate of the present invention with sufficient printing wear resistance. Further, the compound of the formulae (1), (2), (3) and (4) above have an extremely specific effect of preventing decrease in hydrophlicity of the nonimage area. This enables the heat-sensitive lithographic printing plate of the present invention to provide clear printed image, to have sufficient printing wear resistance, and to have improved scumming. In addition, in the case the heat-sensitive lithographic printing plate of the present invention is a direct heat-sensitive lithographic printing plate, in addition to the effects above, an extremely excellent effect of improving sticking phenomenon can also be obtained. As used herein, a direct heat-sensitive lithographic printing plate refers to a heat-sensitive lithographic printing plate used for platemaking methods in which a thermal lithography is directly conducted with thermal head etc.

The compound of formula (1) is explained hereinbelow.

Formula (1)

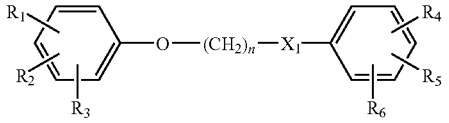

In the formula (1), $X_1$ is —O— or —CO—O—, $R_1$, $R_2$ and $R_3$ are each independently hydrogen atom, alkyl group or aryl group, or $R_1$, $R_2$ and $R_3$, taken together, may form an aromatic ring, $R_4$, $R_5$ and $R_6$ are each independently hydrogen atom, alkyl group or aryl group, or $R_4$, $R_5$ and $R_6$, taken together, may form an aromatic ring, n is an integer of 1 to 10.

In a preferred embodiment of the present invention, the compound of formula (1) is those compound wherein $X_1$ is —O—. In a more preferred embodiment of the present invention, the compound of formula (1) is those compound wherein $R_1$ and $R_6$ are hydrogen atom or alkyl group having 1-4 carbon atoms, $R_2$, $R_3$, $R_4$ and $R_5$ are hydrogen atom, and n is an integer of 1 to 4. The amount of the compound of formula (1) to be added is preferably 30 to 130% by weight based on the amount of the thermoplastic resin, more preferably 50 to 10% by weight. The compound of formula (1) may be used alone, or may be used in combination with other thermofusible materials.

Examples of the compound of formula (1) include, but are not limited to, the following compounds:

(1) 1-(1-naphthoxy)-2-phenoxyethane;
(2) 1-(2-naphthoxy)-4-phenoxybuthane;
(3) 1-(2-isopropylphenoxy)-2-(2-naphthoxy)ethane;
(4) 1-(4-methylphenoxy)-3-(2-naphthoxy)propane;
(5) 1-(2-methylphenoxy)-2-(2-naphthoxy)ethane;
(6) 1-(3-methylphenoxy)-2-(2-naphthoxy)ethane;
(7) 1-(2-naphthoxy)-2-phenoxyethane;
(8) 1-(2-naphthoxy)-6-phenoxyhexane;
(9) 1-phenoxy-2-(2-phenylphenoxy)ethane;
(10) 1-(2-methylphenoxy)-2-(4-phenylphenoxy)ethane;
(11) 1,4-diphenoxybuthane;
(12) 1,4-bis(4-methylphenoxy)buthane;
(13) 1,2-di(3,4-dimethylphenoxy)ethane;
(14) 1-phenoxy-3-(4-phenylphenoxy)propane;
(15) 1-(4-tert-buthylphenoxy)-2-phenoxyethane;
(16) 1,2-diphenoxyethane;
(17) 1-(4-methylphenoxy)-2-phenoxyethane;
(18) 1-(2,3-dimethylphenoxy)-2-phenoxyethane;
(19) 1-(3,4-dimethylphenoxy)-2-phenoxyethane;
(20) 1-(4-ethylphenoxy)-2-phenoxyethane;
(21) 1-(4-isopropylphenoxy)-2-phenoxyethane;
(22) 1,2-bis(2-methylphenoxy)ethane;
(23) 1-(2-methylphenoxy)-2-(4-methylphenoxy)ethane;
(24) 1-(4-tert-buthylphenoxy)-2-(2-methylphenoxy)ethane;
(25) 1,2-bis(3-methylphenoxy)ethane;
(26) 1-(3-methylphenoxy)-2-(4-methylphenoxy)ethane;
(27) 1-(4-ethylphenoxy)-2-(3-methylphenoxy)ethane;
(28) 1,2-bis(4-methylphenoxy)ethane;
(29) 1-(2,3-dimethylphenoxy)-2-(4-methylphenoxy)ethane;
(30) 1-(2,5-dimethylphenoxy)-2-(4-methylphenoxy)ethane;
(31) 2-naphtyl phenoxy acetic acid;
(32) 4-methylphenyl-2-naphthoxy acetic acid; and
(33) 3-methylphenyl-2-naphthoxy acetic acid.

Next, the compound of formula (2) is described below.

Formula (2)

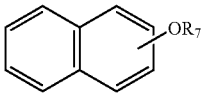

In the formula (2), $R_7$ is alkyl group, aryl group, alkylcarbonyl group, arylcarbonyl group, alkylsulfonyl group or arylsulfonyl group. The naphthalene ring in the formula (2) may have further substituent(s), examples of which include alkyl group, aryl group, halogen atom, hydroxy group, alkoxy group, aryloxy group, alkyloxycarbonyl group, alkoxycarbonyl group, aryloxycarbonyl group, carbamoyl group, sulfamoyl group and the like.

In a preferred embodiment of the present invention, the compound of formula (2) is those compounds wherein $R_7$ is alkyl group having 4-20 carbon atoms, aryl group having 4-24 carbon atoms, alkylcarbonyl group having 2-20 carbon atoms or arylcarbonyl group having 7-20 carbon atoms. In a more preferred embodiment of the present invention, the compound of formula (2) is those compounds wherein the optional substituent of the naphthalene ring is halogen atom, alkyl group having 1-10 carbon atoms, alkyloxycarbonyl group having 2-20 carbon atoms, aryloxycarbonyl group having 7-20 carbon atoms or carbamoyl group having 2-25 carbon atoms. The amount of the compound of formula (2) to be added is preferably 30-130% by weight based on the amount of the thermoplastic resin, more preferably 50-100% by weight. The compound of formula (2) may be used alone, or may be used in combination with other thermofusible materials.

Examples of the compound of formula (2) include, but are not limited to, the following compounds:

(1) 1-benzyloxynaphthalene;
(2) 2-benzyloxynaphthalene;
(3) 2-p-chlorobenzyloxynaphthalene;
(4) 2-p-isopropylbenzyloxynaphthalene;
(5) 2-dodecyloxynaphthalene;
(6) 2-decanoyoxynaphthalene;
(7) 2-myristoyoxynaphthalene;
(8) 2-p-tert-buthylbenzoyloxynaphthalene;
(9) 2-benzoyloxynaphthalene;
(10) 2-benzyloxy-3-N-(3-dodecyloxypropyl)carbamoylnaphthalene;
(11) 2-benzyloxy-3-N-octylcarbamoylnaphthalene;
(12) 2-benzyloxy-3-dodecyloxycarbonylnaphthalene; and
(13) 2-benzyloxy-3-p-tert-buthylphenoxycarbonylnaphthalene.

Next, the compound of formula (3) is described.

Formula (3)

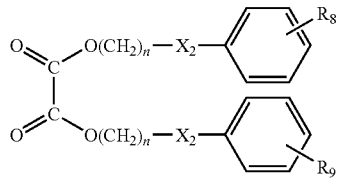

In the formula (3), $R_8$ and $R_9$ are each independently hydrogen atom, halogen atom, alkyl group having 1-4 carbon atoms or alkoxyl group having 1-4 carbon atoms, $X_2$ is a single bond or —O—, n is an integer of 1 to 4.

Examples of the compound of formula (3) include, but are not limited to, the following compounds:

(1) dibenzyloxalate;
(2) di(p-methylbenzyl)oxalate;
(3) di(p-chlorobenzyl)oxalate;
(4) di(m-methylbenzyl)oxalate;
(5) di(p-ethylbenzyl)oxalate;
(6) di(p-methoxybenzyl)oxalate;
(7) bis(2-phenoxyethyl)oxalate;
(8) bis(2-o-chlorophenoxyethyl)oxalate;
(9) bis(2-p-chlorophenoxyethyl)oxalate;
(10) bis(2-p-ethylphenoxyethyl)oxalate;
(11) bis(2-m-methoxyphenoxyethyl)oxalate;
(12) bis(2-p-methoxyphenoxyethyl)oxalate; and
(13) bis(4-phenoxybuthyl)oxalate.

Among these exemplified compounds, specific examples preferably include dibenzyloxalate, di(p-methylbenzyl)oxalate, di(p-chlorobenzyl)oxalate, di(m-methylbenzyl)oxalate, di(p-ethylbenzyl)oxalate, and di(p-methoxybenzyl)oxalate. The amount of the compound of formula (3) to be added is preferably 30-130% by weight based on the amount of the thermoplastic resin, more preferably 50-100% by weight. The compound of formula (3) may be used alone, or may be used in combination with other thermofusible materials.

The compound of formula (4) is described below.

Formula (4)

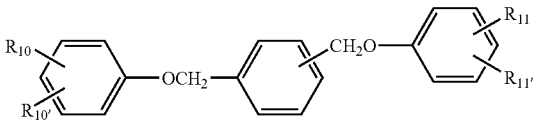

In the formula (4), $R_{10}$, $R_{10'}$, $R_{11}$ and $R_{11'}$ are each independently hydrogen atom, halogen atom, alkyl group, aryl group, alkoxy group, alkylcarbonyl group, arylcarbonyl group, alkoxycarbonyl group or aryloxy group.

Examples of the compound of formula (4) include, but are not limited to, the following compounds:

(1) 1,2-diphenoxymethylbenzene;
(2) 1,3-diphenoxymethylbenzene;
(3) 1,4-di(2-methylphenoxymethyl)benzene;
(4) 1,4-di(3-methylphenoxymethyl)benzene;
(5) 1,3-di(4-methylphenoxymethyl)benzene;
(6) 1,3-di(2,4-dimethylphenoxymethyl)benzene;
(7) 1,3-di(2,6-dimethylphenoxymethyl)benzene;
(8) 1,4-di(2-chlorophenoxymethyl)benzene;
(9) 1,2-di(4-chlorophenoxymethyl)benzene;
(10) 1,3-di(4-chlorophenoxymethyl)benzene;
(11) 1,2-di(4-octylphenoxymethyl)benzene;
(12) 1,3-di(4-octylphenoxymethyl)benzene;
(13) 1,3-di(4-isopropylphenylphenoxymethyl)benzene; and
(14) 1,4-di(4-isopropylphenylphenoxymethyl)benzene.

Among the exemplified compounds, specific examples preferably include 1,2-diphenoxymethylbenzene, 1,4-di(2-methylphenoxymethyl)benzene, 1,4-di(3-methylphenoxymethyl)benzene, and 1,4-di(2-chlorophenoxymethyl)benzene. The amount of the compound of formula (4) to be added is 30-130% by weight based on the amount of the thermoplastic resin, more preferably 50-100% by weight. The compound of formula (4) may be used alone, or may be used in combination with other thermofusible materials.

Among the compounds of formulae (1), (2), (3) and (4), because of providing superior printing wear resistance, the compounds of formulae (1), (2) and (4) are preferred, the compounds of formulae (1) and (2) are more preferred, and the compound of formula (1) is the most preferred. These compounds may be independently used alone, or may be used in combination with each other.

The compounds of formulae (1), (2), (3) and (4) are solid material at ordinary temperature. In order to increase the reactivity with heat, these compounds are preferably subjected to fine dispersion treatment before use. The fine dispersion treatment can be carried out by wet dispersion system which is generally used during paint preparation, such as roll mill, colloid mill, ball mill, attritor, bead mill including sand mill, and the like. For beads used in the bead mill, ceramic beads such as zirconia, titania and alumina, metal beads such as chrome and steel, or glass beads, or the like can be used. The dispersion particle size of the compound obtained by the fine dispersion treatment is preferably 0.1-1.2 μm in median size, more preferably 0.3-0.8 μm. Here, the median size means a particle size (cumulative average particle size) of particulars, obtained graphically by locating the cumulative curve at the midpoint (50%) when the cumulative curve is obtained regarding the entire volume of a mass of particulars as 100%. The median size is one of parameters used for the evaluation of particle size distribution, and can be measured by using laser diffraction/scattering particle size distribution analyzer LA920 (HORIBA, Ltd.) etc.

The thermofusible materials which may be used in combination with the compounds of formulae (1), (2), (3) and (4) are preferably organic compounds having the melting point of 50-150° C., for example, waxes such as carnauba wax, microcrystalline wax, paraffin wax and polyethylene wax; aliphatic acid such as lauric acid, stearic acid, oleic acid, palmitic acid, behenic acid and montanic acid, and esters or amides thereof; and the like. If the thermofusible material has a melting point lower than 50° C., the thermofusible material may melt during the preparation step, thereby leading to a cause of scumming in the printed materials. On the other hand, if the thermo fusible material has a melting point over 150° C., the thermofusible material may be hard to melt during heat exposure with thermal head etc., thereby leading to poor exhibition of lipophilicity. When the thermofusible materials are used in combination with the compounds of formulae (1), (2), (3) and (4), the amount of the thermofusible material to be added is preferably 30% by weight or less based on the amount of the compounds of formulae (1), (2), (3) and (4), more preferably 15% by weight or less.

The image-forming layer comprised in the heat-sensitive lithographic printing plate according to the present invention contains a thermoplastic resin. The thermoplastic resin refers to solid organic polymer compounds comprising linear polymer and exhibiting their plasticity by heating. The thermoplastic resin in the present invention is added to a coating solution used for providing the image-forming layer as a dispersion of the thermoplastic resin in water, the coating solution is then applied and dried so that the thermoplastic resin is present in the image-forming layer as particles of the thermoplastic resin. Typical examples of the thermoplastic resin include synthetic rubber latex such as styrene-butadiene copolymer, acrylonitrile-butadiene copolymer, methyl methacrylate-butadiene copolymer, styrene-acrylonitrile-butadiene copolymer and styrene-methyl methacrylate-butadiene copolymer and modified ones thereof. Examples of the modified ones of the synthetic rubber latex include amino-modified ones, polyether-modified ones, epoxy-modified ones, aliphatic acid-modified ones, carbonyl-modified ones, carboxy-modified ones and the like. Other examples of the thermoplastic resin also include styrene-maleic anhydride copolymer, methyl vinyl ether-maleic anhydride copolymer, polyacrylic acid copolymer, polystyrene, styrene/acrylic acid ester copolymer, polyacrylic acid ester, polymethacrylic acid ester, acrylic acid ester/acrylic acid ester copolymer, and low-melting-point polyamide resin and the like. The thermoplastic resin may be used alone, or may be used in combination with two or more types thereof. The synthetic rubber latex is preferably used for the thermoplastic resin in terms of affinity to vehicles (binder components) in printing ink. The synthetic rubber latex is preferably self-crosslinking type synthetic rubber latex capable of self-crosslinking during heat exposure in terms of printing wear resistance. The self-crosslinking type refers to types capable of forming three-dimensional network with heat even in the absence of a cross-linking agent. The self-crosslinking type synthetic rubber latex can be obtained by using copolymer components having reactive functional groups such as carboxyl group, hydroxy group, methylol amide group, epoxy group, carbonyl group and amino group for preparation. In the case where the heat-sensitive lithographic printing plate of the present invention is a direct heat-sensitive lithographic printing plate, the image-forming layer is preferably the uppermost layer. During printing, the image-forming layer acts as a layer having a lipophilic image area, while as a layer having a hydrophilic nonimage area. Therefore, the reactive functional groups contained in the self-crosslinking type synthetic rubber latex are preferably carboxyl group, hydroxy group and amino group, more preferably carboxyl group. According to this, the image area is capable of self cross-linking with heat to give excellent printing wear resistance, while the nonimage area which has not been exposed to heat is able to obtain excellent water retention ability, so it is preferred. Particularly preferred example of the self-crosslinking type synthetic rubber latex is carboxy-modified styrene-butadiene copolymer. The amount of the thermoplastic resin to be added is preferably 5 to 50% by weight based on the whole solid contents of the image-forming layer, more preferably 10 to 40% by weight. The thermoplastic resin preferably has a glass-transition temperature of 50 to 150° C., more preferably 55 to 120° C. so as to enable their melting and fusing effects to easily exhibit with heat. If the thermoplastic resin has a glass-transition temperature lower than 50° C., the phase change to liquid may be generated during the preparation steps, which makes the nonimage area lipophilic, thereby resulting in the cause of print scumming. If the thermoplastic resin has a glass-transition temperature over 150° C., the thermal fusion of polymer is hard to occur, thereby leading to the difficulty in forming the rigid image when using a relatively-lower output laser or small thermal printer.

The image-forming layer comprised in the heat-sensitive lithographic printing plate according to the present invention contains a water-soluble polymer compound. Examples of the water-soluble polymer compound include, for example, polyvinyl alcohol and modified ones thereof (such as carboxy-modified polyvinyl alcohol, acetoacetyl group-modified polyvinyl alcohol, silanol-modified polyvinyl alcohol), hydroxyethyl cellulose, methylcellulose, carboxymethylcellulose, starch and derivatives thereof, gelatin, casein, sodium alginate, polyvinylpyrrolidone, styrene-maleic acid copolymer salts, styrene-acrylic acid copolymer salts, and the like. The water-soluble polymer compounds may be used alone, or may be used in combination with two or more types thereof. In particular, gelatin, polyvinyl alcohol and modified ones thereof are preferably selected because they have higher film formation ability and preferred for water retention ability of the nonimage area. The amount of the water-soluble polymer compound to be added is preferably 0.5 to 30% by weight based on the amount of the whole solid content of the image-forming layer, more preferably 3 to 25% by weight.

The image-forming layer preferably contains curing agents (water resistant additives) depending on the types of the water-soluble polymer compound so as to increase the water resistance and mechanical strength of the nonimage area. Materials capable of stimulating the cross-linking of the resin to provide water resistance can be used for the curing agent, and examples of which include, for example, melamine resin, epoxy resin, polyisocyanate compounds, aldehyde compounds, silane compounds, chromium alum, divinyl sulfone and the like. In particular, when the water-soluble polymer compound is gelatin, the curing agent to be used is preferably divinyl sulfone. When the water-soluble polymer compound is polyvinyl alcohol, the curing agent to be used is preferably glyoxal. The amount of the curing agent to be added is preferably 1 to 30% by weight based on the solid content of the water-soluble polymer compound, more preferably 2 to 15% by weight in terms of giving a required water resistance and mechanical strength, and avoiding time-dependent property fluctuation during storage.

The image-forming layer comprised in the heat-sensitive lithographic printing plate according to the present invention can further contain a photothermal material in addition to the at least one selected from the compounds of formulae (1), (2), (3) and (4), thermoplastic resin, and water-soluble polymer compound. This enables writing to printing plate by using not only thermal head but also active light such as infrared laser. From this viewpoint, the image-forming layer in the heat-sensitive lithographic printing plate according to the present invention preferably contains a photothermal material. The photothermal material as can be used in the present invention is preferably those materials which efficiently absorbs light and convert into heat. Although it depends on the light source used, when near-infrared light emissible laser diode is used as a light source, the photothermal material to be used is preferably a near-infrared light absorbing agent which has a near-infrared absorption band, examples of which include, for examples, organic compounds such as carbon black, cyanine dyes, polymethine dyes, azulenium dyes, squarylium dyes, thiopyrylium dyes, naphthoquinone dyes and anthraquinone dyes, metallo-organic complex such as phthalocyanine-type, azo-type and thioamide-type, or metal compounds such as iron powder, graphite powder, iron oxide powder, lead oxide, silver oxide, chromic oxide, iron sulfide and chromic sulfide, and the like.

The heat-sensitive lithographic printing plate according to the present invention can contain color developers and color formers (electron-donating dye precursor) such as phenol derivatives and aromatic carboxylic acid derivatives, which are used for general thermosensitive recording paper and pressure-sensitive recording paper, so as to obtain visibility.

Specific examples of the color developers as can be used in the present invention include phenolic compounds such as 4-phenylphenol, 4-cumylphenol, hydroquinone monobenzyl ether, 4,4'-isopropylidene diphenol, 1,1-bis(4-hydroxyphenyl)cyclohexane, 4,4'-dihydroxydiphenyl-2,2-buthane, 4,4'-dihydroxydiphenylmethane, 2,2-bis(4-hydroxyphenyl)propane, 2,2-bis(4-hydroxyphenyl)-4-methylpentane, 2,2-bis(4-hydroxyphenyl)heptane, bis(4-hydroxyphenylthioethoxy)methane, 1,5-di(4-hydroxyphenylthio)-3-oxapentane, 1,1-bis(4-hydroxyphenyl)-1-phenylethane, 1,4-bis[α-methyl-α-

(4'-hydroxyphenyl)ethyl]benzene, 1,3-bis[α-methyl-α-(4'-hydroxyphenyl)ethyl]benzene, 4,4'-dihydroxydiphenylsulfide, di(4-hydroxy-3-methylphenyl) sulfone, 4-hydroxy-4'-methyldiphenylsulfone, 4-hydroxy-4 isopropoxydiphenylsulfone, 2,4'-dihydroxydiphenylsulfone, 4,4'-dihydroxydiphenylsulfone, bis(3-allyl-4-hydroxyphenyl)sulfone, 4-hydroxyphenyl-4'-benzyloxyphenylsulfone, 4-hydroxy-3',4'-tetramethylene biphenylsulfone, 3,4-dihydroxyphenyl-p-tolylsulfone, 4,4'-dihydroxybenzophenone, 4-hydroxy benzyl benzoate, N,N'-di-m-chlorophenylthiourea, and N-(phenoxyethyl)-4-hydroxyphenylsulfonamide; aromatic carboxylic acids and metallic salts thereof such as 4-[3-(p-tolylsulfonyl)propyloxy]salicylic acid, 4-[2-(p-methoxyphenoxy)ethyloxy]salicylic acid, 5-[p-(2-p-methoxyphenoxyethoxy)cumyl]salicylic acid, and p-chlorobenzoic acid; as well as organic acidic substances such as zinc thiocyanate antipyrine complex, and the like.

Specific examples of the color formers (electron-donating dye precursor) as can be used for the heat-sensitive lithographic printing plate according to the present invention include: (1) as triarylmethane compounds, 3,3'-bis(p-dimethylaminophenyl)-6-dimethylaminophthalide (Crystal Violet Lactone), 3,3'-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl) phthalide, 3-(p-dimethylaminophenyl)-3-(2-phenylindol-3-yl)phthalide, 3,3-bis-(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethyl-aminophthalide, and the like; (2) as diphenylmethane compounds, 4,4'-bis-dimethylaminobenzhydrinbenzylether, N-halophenyl leucoauramine, N-2,4,5-trichlorophenylleucoauramine, and the like; (3) as xanthene compounds, rhodamine B-anilinolactam, rhodamine B-p-nitroanilinolactam, rhodamine B-p-chloroanilinolactam, 3-diethylamino-7-dibenzylaminofluoran, 3-diethylamino-7-octylaminofluoran, 3-diethylamino-7-phenylfluoran, 3-diethylamino-7-(3,4-dichloroanilino)fluoran, 3-diethylamino-7-(2-chloroanilino)fluoran, 3-diethylamino-6-methyl-7-anilinofluoran, 3-dibuthylamino-6-methyl-7-anilinofluoran, 3-piperidino-6-methyl-7-anilinofluoran, 3-ethyl-tolylamino-6-methyl-7-anilinofluoran, 3-ethyl-tolylamino-6-methyl-7-phenethylfluoran, 3-diethylamino-7-(4-nitroanilino)fluoran, and the like; (4) as thiazine compounds, benzoylleucomethylene blue, p-nitrobenzoylleucomethylene blue, and the like; (5) as spiro compounds, 3-methyl-spiro-dinaphthopyrane, 3-ethyl-spiro-dinaphthopyrane, 3,3'-dichloro-spiro-dinaphthopyrane, 3-benzyl-spiro-dinaphthopyrane, 3-methylnaphtho-(3-methoxy-benzo)-spiropyrane, 3-propyl-spiro-dibenzopyrane, and the like. These materials may be used in combination with two or more types thereof.

When the heat-sensitive lithographic printing plate of the present invention is a direct heat-sensitive lithographic printing plate, the image-forming layer is preferably the uppermost layer. In this case, during printing, the uppermost layer acts as a layer having a lipophilic image area, while as a layer having a hydrophilic nonimage area. In general, as thermal lithography is carried out by using thermal head etc., a thermofusible material and thermoplastic particles contained in the image-forming layer melt over a certain temperature. The material which has melted and then been attached or fixed to the thermal head is "head debris". The head debris is fixed between the printing plates to generate sticking, which generates white lines on the image and makes the printing noise larger. However, in the present invention, according to the fact that the image-forming layer in the direct heat-sensitive lithographic printing plate contains at least one selected from the compounds of formulae (1), (2), (3) and (4) as mentioned above, effects of obtaining clear printed image, having sufficient printing wear resistance, and having reduced scumming, as well as an extremely superior effect of having improved sticking phenomenon, can be obtained.

Conventionally, in thermosensitive recording papers in general, inorganic pigments having higher oil absorbability such as silicon dioxide, zinc oxide, titanium dioxide, aluminum hydroxide, calcium carbonate are formulated thereto so long as it does not pose any problems on the image lithography. The thermally-fused materials are absorbed into the inorganic pigments, which prevents the attachment or fixing with the thermal head to improve sticking phenomenon. However, if the image-forming layer in the heat-sensitive lithographic printing plate contains the inorganic pigments above, printing wear resistance tends to be decreased. Accordingly, in the present invention, it is preferred that the image-forming layer does not substantially contain an inorganic pigment. Here, the phrase "does not substantially contain an inorganic pigment" means that the amount of the inorganic pigment added is less than 10% by weight based on the whole solid content of the image-forming layer, more preferably less than 5% by weight.

The image-forming layer comprised in the heat-sensitive lithographic printing plate according to the present invention preferably has the dried film thickness of 0.5 to 20 μm, more preferably 1 to 10 μm, in terms of printing wear resistance of the image area, and water resistance and mechanical strength of the nonimage area.

For the water-resistant support comprised in the heat-sensitive lithographic printing plate according to the present invention, plastic film, resin-coated paper, water resistant paper and the like can be used. Specific examples of the water-resistant support include plastic film such as polyolefin including polyethylene and polypropylene, polyethersulfone, polyester, poly(meth)acrylate, polycarbonate, polyamide and polyvinyl chloride; a resin-coated paper in which the plastic is laminated or applied to the surface; a water-resistant paper in which paper strength agents such as melamine-formaldehyde resin, urea formaldehyde resin, epoxidized polyamide resin is used for making the paper water resistance.

The water-resistant support in the present invention preferably has the thickness of about 100 to 300 μm, in terms of recording suitability for thermal platemaking equipments and suitability for litho printing equipments.

The surface of the water-resistant support may be subject to treatments such as plasma treatment, corona discharge treatment, ultraviolet radiation treatment and undercoating treatment so as to increase adhesion between the support and the image-forming layer. The undercoating layer to be provided on the water-resistant support by the undercoating treatment can contain acetal resin such as polyvinyl butyral, polyester resin having hydroxyl group at the end of the molecular chain, and resins selected from (meth)acrylic acid-(meth)acrylic acid ester copolymer, vinylidene chloride-vinyl chloride copolymer and the like. The undercoating layer preferably has the dried film thickness of about 0.1 to 10 μm in general.

The heat-sensitive lithographic printing plate according to the present invention can be prepared by mixing the each material for the image-forming layer, dissolving or dispersing the mixture in a suitable solvent to provide a coating solution, applying the coating solution onto the water-resistant support by known coating methods, and drying. The solvent is preferably water. However, the drying process is preferably carried out at the atmosphere less than 50° C. for about 30 seconds to 10 minutes so that the image-forming layer (and interlayer) cannot be heat-denatured by heat during the drying.

Also, the heat-sensitive lithographic printing plate according to the present invention may have the undercoating layer as mentioned above so as to improve the adhesion between the image-forming layer with the support. In addition, properties such as conductive property and antistatic property may be applied to the heat-sensitive lithographic printing plate according to the present invention, if needed. Besides, plural layers such as an anti-curling layer for preventing the printing plate from curling, or a pro-curling layer for imparting a desired curling may be applied to the heat-sensitive lithographic printing plate according to the present invention.

Next, platemaking methods using the above-mentioned heat-sensitive lithographic printing plate according to the present invention are described below. The heat-sensitive lithographic printing plate according to the present invention has a heat-sensitive image-forming layer. In the heat-sensitive lithographic printing plate according to the present invention, when the image-forming layer contains a photothermal material, image areas can be formed by light exposure including infrared light of 760 nm to 1200 nm, for example. It is more preferred that the image area is formed by using a solid-state laser and laser diode of infrared radiation. In particular, by using laser exposure, desired image patterns can be recorded directly from computer digital information. In addition, in the heat-sensitive lithographic printing plate according to the present invention, it is also possible to subject an image-forming layer directly to thermal lithography by using thermal head, heat block and the like to form image areas. By using thermal head, desired image patterns can be recorded directly from computer digital information.

When the thermal head is used, line printer using thick or thin film line head, serial printer using thin film serial head, or the like can be used. The recording energy density is preferably 10 to 100 mJ/mm$^2$. The head preferably has the image recording density over 300 dpi so as to obtain output image with relatively high quality.

EXAMPLES

In the following, examples of the present invention are described, but the present invention is not limited to the examples. In the examples below, "parts" and "%" means "parts by weight" and "% by weight" respectively, unless otherwise indicated.

Example 1

1,2-Bis(3-methylphenoxy)ethane (available from SANKYO CO., LTD., KS-232) as a compound of formula (1), a color developer: 4-hydroxy-4'-isopropoxydiphenylsulfone (available from NIPPON SODA CO., LTD., D-8), and a color former: 3-dibuthylamino-6-methyl-7-anilinofluoran (available from Yamamoto Chemicals, Inc., ODB2) were previously and individually subject to fine dispersion treatment in a 30% solid content concentration by using small Dyno-mill (bead mill) with zirconia beads, to provide Dispersion 1 (the compound of formula (1)), Dispersion 2 (the color developer), Dispersion 3 (the color former), respectively. The dispersion particle size (median size) of Dispersion 1 was measured by using LA920 (HORIBA, Ltd.) and was 0.52 μm. The image-forming layer-coating solution 1 was prepared by the following formulation.

[Image-Forming Layer-Coating Solution 1]

| | |
|---|---|
| Water-soluble polymer compound: Gelatin (12% aqueous solution) (Nippi, Inc., IK3000) | 80 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Compound of formula (1): Dispersion 1 (30% dispersion) | 30 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

A polyethylene double coated paper having the thickness of 180 μm was subject to corona discharge treatment, thereto was then applied an image-forming layer-coating solution having the formulation above to provide an image-forming layer having dried film thickness of 5 μm, to obtain a direct heat-sensitive lithographic printing plate of the present invention. To the direct heat-sensitive lithographic printing plate thus prepared, image was recorded by using a direct thermal printer (TOSHIBA TEC CORPORATION, Barcord printer B-433 line system Thermal Head 300 dpi) in a test printing mode (print speed: 2 inch/sec, applied energy: 18.6 mJ/mm$^2$). Then, to this printing plate, printing was carried out by using offset printer (HAMADA H234C: HAMADA PRINTING PRESS CO., LTD.), ink; New champion F-gross ink N: DIC Corporation, fountain solution; SLM-OD30: Mitsubishi Paper Mills Ltd., 3% diluted solution. Presence or absence of sticking, and print performance were evaluated.

Regarding the sticking, evaluation was carried out by observing if white lines, generated at right angle to printing direction, were present or not at solid black parts in printed materials. Regarding the evaluation of the print performance, the following three items: (1) image clearness, (2) print scumming, (3) printing wear resistance were observed as follows.

(1) Image Clearness

The image clearness was determined by observing the darkness and outline sharpness of printed image (10-point character) at the time 20 sheets were printed. The following criteria are used

| | |
|---|---|
| ○ | The printed character had high density and sharp outline. |
| Δ | The printed character had high density but unsharp outline. |
| × | The printed character had low density and unsharp outline. |

(2) Print Scumming

The print scumming was evaluated by observing how much extent scumming is present on the background at the time 100 sheets were printed. The following criteria are used

| | |
|---|---|
| ○ | No scumming at all |
| Δ | Tiny dotted scumming was slightly generated (level available for commercial printing) |
| × | Scumming was generated at whole area (level unavailable for commercial printing) |

(3) Printing Wear Resistance (Number of Sheets)

This was evaluated by determining the rough number by 100 sheets until bad stained ink was observed at image area of the printed materials.

Results of the evaluation above were shown in Table 1 below.

Example 2

The image-forming layer-coating solution 2 having the following formulation was prepared by changing 1,2-bis(3-methylphenoxy)ethane used in Example 1 to 1,2-diphenoxyethane (SANKYO CO., LTD., KS-235), changing water-soluble polymer compound from gelatin to silanol-modified polyvinyl alcohol (KURARAY CO. LTD., R1130), and changing curing agent to glyoxal. 1,2-Diphenoxyethane was previously subjected to fine dispersion treatment in a 30% solid content concentration by using small Dyno-mill (bead mill) with zirconia beads to provide Dispersion 4. The dispersion particle size (median size) of Dispersion 4 was measured by using LA920 (HORIBA, Ltd.) and was 0.68 μm.

[Image-Forming Layer-Coating Solution 2]

| | |
|---|---|
| Water-soluble polymer compound: Silanol-modified PVA (10% aqueous solution) (KURARAY CO. LTD., R Polymer, R1130) | 100 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Compound of formula (1): Dispersion 4 (30% dispersion) | 30 parts |
| Color developer: Dispersion 2 (30% dispersion) | 30 parts |
| Color former: Dispersion 3 (30% dispersion) | 9 parts |
| Curing agent: Glyoxal | 0.8 parts |

In the same manner as Example 1, the image-forming layer-coating solution having the formulation above was applied to polyethylene double coated paper having the thickness of 180 μm to provide an image-forming layer having a dried film thickness of 5 μm, to obtain a direct heat-sensitive lithographic printing plate of the present invention. To the direct heat-sensitive lithographic printing plate thus prepared, image was recorded by using a direct thermal printer, printing was then carried out by using offset printer, in the same manner as Example 1. Presence or absence of sticking, and print performance were evaluated. The results are shown in Table 1.

Example 3

The image-forming layer-coating solution 3 having the following formulation was prepared by adding carbon black as a photothermal agent to the image-forming layer-coating solution used in Example 2.

[Image-Forming Layer-Coating Solution 3]

| | |
|---|---|
| Water-soluble polymer compound: Silanol-modified PVA (10% aqueous solution) (KURARAY CO. LTD., R Polymer, R1130) | 100 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Compound of formula (1): Dispersion 4 (30% dispersion) | 30 parts |
| Color developer: Dispersion 2 (30% dispersion) | 30 parts |
| Color former: Dispersion 3 (30% dispersion) | 9 parts |
| Photothermal agent: Carbon black (DIC Corporation, SD9020) | 5 parts in solid |
| Curing agent: Glyoxal (The Nippon Synthetic Chemical Industry Co., Ltd.) | 0.8 parts |

A polyester film having the thickness of 100 μm was subject to corona discharge treatment, thereto was then applied an image-forming layer-coating solution having the formulation above to provide an image-forming layer having dried film thickness of 5 μm, to obtain a heat-sensitive lithographic printing plate of the present invention. To the heat-sensitive lithographic printing plate thus prepared, image exposure was carried out by using laser diode (wavelength: 830 nm, output: 500 mw). The resolution was set to 2400 dpi in both scanning direction and sub-scanning direction. After image exposure, printing was carried out by using offset printer in the same manner as Example 1, and print performance was evaluated. Results are shown in Table 1.

Example 4

The image-forming layer-coating solution 4 below was prepared in the same manner as Example 1 except for adding silicon dioxide in 5.3% based on the whole solid content to the image-forming layer-coating solution used in Example 1.

[Image-Forming Layer-Coating Solution 4]

| | |
|---|---|
| Inorganic pigment: Silicon dioxide (TOSOH SILICA CORPORATION, AY-601) | 2.5 parts |
| Water-soluble polymer compound: Gelatin (12% aqueous solution) (Nippi, Inc., IK3000) | 80 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Compound of formula (1): Dispersion 1 (30% dispersion) | 30 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

In the same manner as Example 1, the image-forming layer-coating solution having the formulation above was applied to polyethylene double coated paper having the thickness of 180 μm to provide an image-forming layer having a dried film thickness of 5 μm, to obtain a direct heat-sensitive lithographic printing plate of the present invention. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

Example 5

The image-forming layer-coating solution 5 below was prepared in the same manner as Example 1 except for adding silicon dioxide in 10.2% based on the whole solid content to the image-forming layer-coating solution used in Example 1.

[Image-forming layer-coating solution 5]

| | |
|---|---|
| Inorganic pigment: Silicon dioxide (TOSOH SILICA CORPORATION, AY-601) | 5.1 parts |
| Water-soluble polymer compound: Gelatin (12% aqueous solution) (Nippi, Inc., IK3000) | 80 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Compound of formula (1): Dispersion 1 (30% dispersion) | 30 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

In the same manner as Example 1, the image-forming layer-coating solution having the formulation above was applied to polyethylene double coated paper having the thickness of 180 μm to provide an image-forming layer having a dried film thickness of 5 μm, to obtain a direct heat-sensitive lithographic printing plate of the present invention. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

Example 6

2-Benzyloxynaphthalene (Yamada Chemical Co., Ltd., BON) as a compound of formula (2) was previously subject to fine dispersion treatment by using small Dyno-mill in the same manner as Example 1 to provide Dispersion 5 (dispersion particle size: 0.82 μm). The image-forming layer-coating solution 6 was prepared in the same manner as Example 1 except for using Dispersion 5 instead of Dispersion 1 used in Example 1, and applied to polyethylene double coated paper to provide a direct heat-sensitive lithographic printing plate of the present invention. Then, image was recorded by using a direct thermal printer, then printing was carried out by using offset printer, in the same manner as Example 1. Print performance, and presence or absence of sticking were evaluated. The results are shown in Table 1.

Example 7

2-p-Chlorobenzyloxynaphthalene (reagent) as a compound of formula (2) was previously subject to fine dispersion treatment by using small Dyno-mill in the same manner as Example 2 to provide Dispersion 6 (dispersion particle size: 1.25 μm). The image-forming layer-coating solution 7 was prepared in the same manner as Example 2 except for using Dispersion 6 instead of Dispersion 4 used in Example 2, and applied to polyethylene double coated paper to provide a direct heat-sensitive lithographic printing plate of the present invention. Then, image was recorded by using a direct thermal printer, then printing was carried out by using offset printer, in the same manner as Example 1. Print performance, and presence or absence of sticking were evaluated. The results are shown in Table 1.

Example 8

The image-forming layer-coating solution 8 was prepared in the same manner as Example 3 except for using Dispersion 6 instead of Dispersion 4 in Example 3. The image-forming layer-coating solution was applied to a polyester film in the same manner as Example 3 to provide a heat-sensitive lithographic printing plate of the present invention. In the same manner as Example 3, image exposure was carried out by using laser diode, and printing was carried out by using offset printer, and print performance was evaluated. Results of the evaluation are shown in Table 1.

Example 9

The image-forming layer-coating solution 9 was prepared in the same manner as Example 4 except for using Dispersion 5 instead of Dispersion 1 used in Example 4. In the same manner as Example 4, the image-forming layer-coating solution was applied to polyethylene double coated paper to provide a direct heat-sensitive lithographic printing plate of the present invention. Then, image was recorded by using a direct thermal printer, then printing was carried out by using offset printer, in the same manner as Example 1. Print performance and presence or absence of sticking were evaluated. The results are shown in Table 1.

Example 10

The image-forming layer-coating solution 10 was prepared in the same manner as Example 5 except for using Dispersion 5 instead of Dispersion 1 used in Example 5. In the same manner as Example 5, the image-forming layer-coating solution was applied to polyethylene double coated paper to provide a direct heat-sensitive lithographic printing plate of the present invention. Then, image was recorded by using a direct thermal printer, then printing was carried out by using offset printer, in the same manner as Example 1. Print performance and presence or absence of sticking were evaluated. The results are shown in Table 1.

Example 11

Di(p-methylbenzyl)oxalate (DIC Corporation, HS3520) as a compound of formula (3) was previously subject to fine dispersion treatment by using small Dyno-mill in the same manner as Example 1 to provide Dispersion 7 (dispersion particle size: 0.68 μm). The image-forming layer-coating solution 11 was prepared in the same manner as Example 1 except for using Dispersion 7 instead of Dispersion 1 used in Example 1, and applied to polyethylene double coated paper to provide a direct heat-sensitive lithographic printing plate of the present invention. Then, image was recorded by using a direct thermal printer, then printing was carried out by using offset printer, in the same manner as Example 1. Print performance, and presence or absence of sticking were evaluated. The results are shown in Table 1.

Example 12

Dibenzyloxalate (DIC Corporation, HS2046) as a compound of formula (3) was previously subject to fine dispersion treatment by using small Dyno-mill in the same manner as Example 2 to provide Dispersion 8 (dispersion particle size: 0.52 μm). The image-forming layer-coating solution 12 was prepared in the same manner as Example 2 except for using Dispersion 8 instead of Dispersion 4 used in Example 2, and applied to polyethylene double coated paper to provide a direct heat-sensitive lithographic printing plate of the present invention. Then, image was recorded by using a direct thermal printer, then printing was carried out by using offset printer, in the same manner as Example 1. Print performance, and presence or absence of sticking were evaluated. The results are shown in Table 1.

Example 13

The image-forming layer-coating solution 13 was prepared in the same manner as Example 3 except for using Dispersion 8 instead of Dispersion 4 in Example 3. The image-forming layer-coating solution was applied to polyester film in the same manner as Example 3 to provide a heat-sensitive lithographic printing plate of the present invention. In the same manner as Example 3, image exposure was carried out by using laser diode, and printing was carried out by using offset printer, and print performance was evaluated. Results of the evaluation are shown in Table 1.

Example 14

The image-forming layer-coating solution 14 was prepared in the same manner as Example 4 except for using Dispersion 7 instead of Dispersion 1 used in Example 4. In the same manner as Example 4, the image-forming layer-coating solution was applied to polyethylene double coated paper to provide a direct heat-sensitive lithographic printing plate of the present invention. Then, image was recorded by using a direct thermal printer, then printing was carried out by using offset printer, in the same manner as Example 1. Print performance and presence or absence of sticking were evaluated. The results are shown in Table 1.

Example 15

The image-forming layer-coating solution 15 was prepared in the same manner as Example 51 except for using Dispersion 7 instead of Dispersion 1 used in Example 5. In the same manner as Example 5, the image-forming layer-coating solution was applied to polyethylene double coated paper to provide a direct heat-sensitive lithographic printing plate of the present invention. Then, image was recorded by using a direct thermal printer, then printing was carried out by using offset printer, in the same manner as Example 1. Print performance and presence or absence of sticking were evaluated. The results are shown in Table 1.

Example 16

1,2-Diphenoxymethylbenzene (NICCA CHEMICAL CO., LTD., PMB-2) as a compound of formula (4) was previously subject to fine dispersion treatment by using small Dyno-mill in the same manner as Example 1 to provide Dispersion 9 (dispersion particle size: 0.75 μm). The image-forming layer-coating solution 16 was prepared in the same manner as Example 1 except for using Dispersion 9 instead of Dispersion 1 used in Example 1, and applied to polyethylene double coated paper to provide a direct heat-sensitive lithographic printing plate of the present invention. Then, image was recorded by using a direct thermal printer, then printing was carried out by using offset printer, in the same manner as Example 1. Print performance, and presence or absence of sticking were evaluated. The results are shown in Table 1.

Example 17

1,4-Di(2-methylphenoxymethyl)benzene (reagent) as a compound of formula (4) was previously subject to fine dispersion treatment by using small Dyno-mill in the same manner as Example 2 to provide Dispersion 10 (dispersion particle size: 0.97 μm). The image-forming layer-coating solution 17 was prepared in the same manner as Example 2 except for using Dispersion 10 instead of Dispersion 4 used in Example 2, and applied to polyethylene double coated paper to provide a direct heat-sensitive lithographic printing plate of the present invention. Then, image was recorded by using a direct thermal printer, then printing was carried out by using offset printer, in the same manner as Example 1. Print performance, and presence or absence of sticking were evaluated. The results are shown in Table 1.

Example 18

The image-forming layer-coating solution 18 was prepared in the same manner as Example 3 except for using Dispersion 10 instead of Dispersion 4 in Example 3. The image-forming layer-coating solution was applied to polyester film in the same manner as Example 3 to provide a heat-sensitive lithographic printing plate of the present invention. In the same manner as Example 3, image exposure was carried out by using laser diode, and printing was carried out by using offset printer, and print performance was evaluated. Results of the evaluation are shown in Table 1.

Example 19

The image-forming layer-coating solution 19 was prepared in the same manner as Example 4 except for using Dispersion 9 instead of Dispersion 1 used in Example 4. In the same manner as Example 4, the image-forming layer-coating solution was applied to polyethylene double coated paper to provide a direct heat-sensitive lithographic printing plate of the present invention. Then, image was recorded by using a direct thermal printer, then printing was carried out by using offset printer, in the same manner as Example 1. Print performance and presence or absence of sticking were evaluated. The results are shown in Table 1.

Example 20

The image-forming layer-coating solution 20 was prepared in the same manner as Example 5 except for using Dispersion 9 instead of Dispersion 1 used in Example 5. In the same manner as Example 5, the image-forming layer-coating solution was applied to polyethylene double coated paper to provide a direct heat-sensitive lithographic printing plate of the present invention. Then, image was recorded by using a direct thermal printer, then printing was carried out by using offset printer, in the same manner as Example 1. Print performance and presence or absence of sticking were evaluated. The results are shown in Table 1.

Example 21

The image-forming layer-coating solution 21 below was prepared in the same manner as Example 1 except for adding stearic acid amide in 20% based on the solid content of 1,2-bis(3-methylphenoxy)ethane in Dispersion 1 to the image-forming layer-coating solution used in Example 1.

[Image-Forming Layer-Coating Solution 21]

| | |
|---|---|
| Water-soluble polymer compound: Gelatin (12% aqueous solution) (Nippi, Inc., IK3000) | 80 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Compound of formula (1): Dispersion 1 (30% dispersion) | 30 parts |
| Stearic acid amide dispersion (nonvolatile content: 25%) (CHUKYO YUSHI CO., LTD., Hymicron L271) | 7.2 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

In the same manner as Example 1, the image-forming layer-coating solution having the formulation above was applied to polyethylene double coated paper having the thickness of 180 μm to provide an image-forming layer having a dried film thickness of 5 μm, to obtain a direct heat-sensitive lithographic printing plate of the present invention. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

Example 22

The image-forming layer-coating solution 22 below was prepared in the same manner as Example 1 except for using styrene-butadiene copolymer (DIC Corporation, LACSTER DS-206) instead of carboxy-modified styrene-butadiene copolymer (LACSTER 7132-C) used in Example 1.

[Image-Forming Layer-Coating Solution 22]

| | |
|---|---|
| Water-soluble polymer compound: Gelatin (12% aqueous solution) (Nippi, Inc., IK3000) | 80 parts |
| Thermoplastic resin: Styrene-butadiene copolymer (Water dispersion, solid content: 49%) (DIC Corporation, LACSTER DS-206, Tg: 25° C.) | 30 parts |
| Compound of formula (1): Dispersion 1 (30% dispersion) | 30 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

In the same manner as Example 1, the image-forming layer-coating solution having the formulation above was applied to polyethylene double coated paper having the thickness of 180 μm to provide an image-forming layer having a dried film thickness of 5 μm, to obtain a direct heat-sensitive lithographic printing plate of the present invention. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

Example 23

The image-forming layer-coating solution 23 below was prepared in the same manner as Example 1 except for using carbonyl-modified styrene-butadiene copolymer (ZEON CORPORATION, NipolLX407BP) instead of carboxy-modified styrene-butadiene copolymer (LACSTER 7132-C) used in Example 1.

[Image-Forming Layer-Coating Solution 23]

| | |
|---|---|
| Water-soluble polymer compound: Gelatin (12% aqueous solution) (Nippi, Inc., IK3000) | 80 parts |
| Thermoplastic resin: Styrene-butadiene copolymer (Water dispersion, solid content: 50%) (ZEON CORPORATION, NipolLX407BP, Tg: 80° C.) | 30 parts |
| Compound of formula (1): Dispersion 1 (30% dispersion) | 30 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

In the same manner as Example 1, the image-forming layer-coating solution having the formulation above was applied to polyethylene double coated paper having the thickness of 180 μm to provide an image-forming layer having a dried film thickness of 5 μm, to obtain a direct heat-sensitive lithographic printing plate of the present invention. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

Comparative Example 1

The image-forming layer-coating solution 24 below was prepared in the same manner as Example 1 except for removing Dispersion 1 of the compound of formula (1), 1,2-bis(3-methylphenoxy)ethane from the image-forming layer-coating solution used in Example 1.

[Image-Forming Layer-Coating Solution 24]

| | |
|---|---|
| Water-soluble polymer compound: Gelatin (12% aqueous solution) (Nippi, Inc., IK3000) | 80 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

The polyethylene double coated paper having the thickness of 180 μm was subject to corona discharge treatment, and then the image-forming layer-coating solution 24 having the formulation above was applied thereto to provide an image-forming layer having a dried film thickness of 5 μm, to obtain a direct heat-sensitive lithographic printing plate of Comparative Example 1. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

Comparative Example 2

The image-forming layer-coating solution 25 below was prepared in the same manner as Example 1 except for removing Dispersion 1 of the compound of formula (1), 1,2-bis(3-methylphenoxy)ethane from the image-forming layer-coating solution used in Example 1 and adding silicon dioxide in 28.0% based on the whole solid content.

[Image-forming layer-coating solution 25]

| | |
|---|---|
| Inorganic pigment: Silicon dioxide (TOSOH SILICA CORPORATION, AY-601) | 14 parts |
| Water-soluble polymer compound: Gelatin (12% aqueous solution) (Nippi, Inc., IK3000) | 80 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

The polyethylene double coated paper having the thickness of 180 μm was subject to corona discharge treatment, and then the image-forming layer-coating solution 25 having the formulation above was applied thereto to provide an image-forming layer having a dried film thickness of 5 μm, to obtain a direct heat-sensitive lithographic printing plate of Comparative Example 2. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

Comparative Example 3

The image-forming layer-coating solution 26 below was prepared in the same manner as Example 1 except for using an equal amount of paraffin wax dispersion (CHUKYO YUSHI CO., LTD., Hydrin L703, melting point: 75° C.) instead of Dispersion 1 of the compound of formula (1), 1,2-bis(3-methylphenoxy)ethane used in Example 1.

[Image-Forming Layer-Coating Solution 26]

| | |
|---|---|
| Water-soluble polymer compound: Gelatin (12% aqueous solution) (Nippi, Inc., IK3000) | 80 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Paraffin wax dispersion (nonvolatile content: 35%) (CHUKYO YUSHI CO., LTD., Hydrin L703) | 26 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

The polyethylene double coated paper having the thickness of 180 μm was subject to corona discharge treatment, and then the image-forming layer-coating solution 26 having the formulation above was applied thereto to provide an image-forming layer having a dried film thickness of 5 μm, to obtain a direct heat-sensitive lithographic printing plate of Comparative Example 3. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

Comparative Example 4

The image-forming layer-coating solution 27 below was prepared in the same manner as Example 1 except for using an equal amount of carnauba wax dispersion (CHUKYOYUSHI CO., LTD., Celosol 524, melting point: 83° C.) instead of Dispersion 1 of the compound of formula (1), 1,2-bis(3-methylphenoxy)ethane used in Example 1.

[Image-Forming Layer-Coating Solution 27]

| | |
|---|---|
| Water-soluble polymer compound: Gelatin (12% aqueous solution) (Nippi, Inc., IK3000) | 80 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Carnauba wax dispersion (nonvolatile content: 30%) (CHUKYO YUSHI CO., LTD., Celosol 524) | 30 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

The polyethylene double coated paper having the thickness of 180 μm was subject to corona discharge treatment, and then the image-forming layer-coating solution 27 having the formulation above was applied thereto to provide an image-forming layer having a dried film thickness of 5 μm, to obtain a direct heat-sensitive lithographic printing plate of Comparative Example 4. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

Comparative Example 5

The image-forming layer-coating solution 28 below was prepared in the same manner as Example 1 except for using an equal amount of montanate wax dispersion (CHUKYO YUSHI CO., LTD., Hydrin J537, melting point: 83° C.) instead of Dispersion 1 of the compound of formula (1), 1,2-bis(3-methylphenoxy)ethane used in Example 1.

[Image-Forming Layer-Coating Solution 28]

| | |
|---|---|
| Water-soluble polymer compound: Gelatin (12% aqueous solution) (Nippi, Inc., IK3000) | 80 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Montanate wax dispersion (nonvolatile content: 30%) (CHUKYO YUSHI CO., LTD., Hydrin J537) | 30 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

The polyethylene double coated paper having the thickness of 180 μm was subject to corona discharge treatment, and then the image-forming layer-coating solution 28 having the formulation above was applied thereto to provide an image-forming layer having a dried film thickness of 5 μm, to obtain a direct heat-sensitive lithographic printing plate of Comparative Example 5. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

Comparative Example 6

The image-forming layer-coating solution 29 below was prepared in the same manner as Example 1 except for using an equal amount of dispersion of stearic acid amide (CHUKYO YUSHI CO., LTD., Hymicron L271, melting point: 100° C.) instead of Dispersion 1 of the compound of formula (1), 1,2-bis(3-methylphenoxy)ethane used in Example 1.

[Image-Forming Layer-Coating Solution 29]

| | |
|---|---|
| Water-soluble polymer compound: Gelatin (12% aqueous ( solution) Nippi, Inc., IK3000) | 80 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Stearic acid amide dispersion (nonvolatile content: 25%) (CHUKYO YUSHI CO., LTD., Hymicron L271) | 36 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

The polyethylene double coated paper having the thickness of 180 μm was subject to corona discharge treatment, and then the image-forming layer-coating solution 29 having the formulation above was applied thereto to provide an image-forming layer having a dried film thickness of 5 μm, to obtain a direct heat-sensitive lithographic printing plate of Comparative Example 6. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

Comparative Example 7

The image-forming layer-coating solution 30 below was prepared in the same manner as Example 1 except for using an equal amount of zinc stearate dispersion (CHUKYO YUSHI CO., LTD., Hydrin Z7, melting point: 120° C.) instead of Dispersion 1 of the compound of formula (1), 1,2-bis(3-methylphenoxy)ethane used in Example 1.

[Image-Forming Layer-Coating Solution 30]

| | |
|---|---|
| Water-soluble polymer compound: Gelatin (12% aqueous solution) (Nippi, Inc., IK3000) | 80 parts |
| Thermoplastic resin: Carboxy-modified styrene-butadiene copolymer (Water dispersion, solid content: 45%) (DIC Corporation, LACSTER 7132-C, Tg: 60° C.) | 30 parts |
| Zinc stearate dispersion (nonvolatile content: 31%) (CHUKYO YUSHI CO., LTD., Hydrin Z7) | 29 parts |
| Color developer: Dispersion 2 (30% dispersion) | 30 parts |
| Color former: Dispersion 3 (30% dispersion) | 9 parts |
| Curing agent: Divinyl sulfone | 1.2 parts |

The polyethylene double coated paper having the thickness of 180 μm was subject to corona discharge treatment, and then the image-forming layer-coating solution 30 having the formulation above was applied thereto to provide an image-forming layer having a dried film thickness of 5 μm, to obtain a direct heat-sensitive lithographic printing plate of Comparative Example 7. To the direct heat-sensitive lithographic printing plate thus prepared, image was recorded by using a direct thermal printer, then printing was carried out by using offset printer, in the same manner as Example 1. Presence or absence of sticking, and print performance were evaluated. The results are shown in Table 1.

TABLE 1

| | Print Clearness | Print Scumming | Printing wear resistance (Number of Sheets) | Sticking |
|---|---|---|---|---|
| Example 1 | ○ | ○ | 7000 | None |
| Example 2 | ○ | ○ | 6000 | None |
| Example 3 | ○ | ○ | 5000 | — |
| Example 4 | ○ | ○ | 4500 | None |
| Example 5 | ○ | ○ | 2500 | None |
| Example 6 | ○ | ○ | 6000 | None |
| Example 7 | ○ | ○ | 5500 | None |
| Example 8 | ○ | ○ | 4500 | — |
| Example 9 | ○ | ○ | 4000 | None |
| Example 10 | ○ | ○ | 2000 | None |
| Example 11 | ○ | ○ | 4500 | None |
| Example 12 | ○ | ○ | 4000 | None |
| Example 13 | ○ | ○ | 3000 | — |
| Example 14 | ○ | ○ | 3000 | None |
| Example 15 | ○ | ○ | 1500 | None |
| Example 16 | ○ | ○ | 5000 | None |
| Example 17 | ○ | ○ | 5300 | None |
| Example 18 | ○ | ○ | 4200 | — |
| Example 19 | ○ | ○ | 3500 | None |
| Example 20 | ○ | ○ | 1800 | None |
| Example 21 | ○ | ○ | 6000 | None |
| Example 22 | ○ | Δ | 4000 | None |
| Example 23 | ○ | Δ | 6500 | None |
| Comparative Example 1 | × | ○ | 300 | Present |
| Comparative Example 2 | × | ○ | 100 | None |
| Comparative Example 3 | Δ | Δ | 500 | Present |
| Comparative Example 4 | Δ | × | 800 | Present |
| Comparative Example 5 | ○ | Δ | 1000 | Present |
| Comparative Example 6 | ○ | × | 1200 | Present |
| Comparative Example 7 | Δ | ○ | 1000 | Present |

As seen from the results shown in Table 1, according to the fact that the image-forming layer contains at least one selected from the compounds of formulae (1), (2), (3) and (4), a heat-sensitive lithographic printing plate having clear printed image, less scumming, and excellent printing wear resistance can be obtained. Also, a direct heat-sensitive lithographic printing plate that has reduced sticking which is a problem in the conventional direct heat-sensitive lithographic printing plate, and that has good balance between lipophilicity of image area and hydrophlicity of nonimage area, can be obtained. In addition, as indicated in Examples above, the heat-sensitive lithographic printing plate of the present invention is capable of platemaking by lithography using thermal head or infrared laser without subsequent developing treatment.

The invention claimed is:

1. A heat-sensitive lithographic printing plate comprising, on a water-resistant support, an image-forming layer containing a thermoplastic resin having a glass-transition temperature of 50 to 150° C., a water-soluble polymer compound, and at least one compound selected from a compound of the following formulae (1), (2), (3), and (4):

Formula (1)

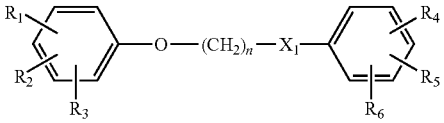

wherein, $X_1$ is —O— or —CO—O—, $R_1$, $R_2$ and $R_3$ are each independently hydrogen atom, alkyl group or aryl group, or $R_1$, $R_2$ and $R_3$, taken together, form an aromatic ring, $R_4$, $R_5$ and $R_6$ are each independently hydrogen atom, alkyl group or aryl group, or $R_4$, $R_5$ and $R_6$, taken together, form an aromatic ring, n is an integer of 1 to 10;

Formula (2)

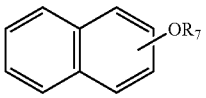

wherein, $R_7$ is alkyl group, aryl group, alkylcarbonyl group, arylcarbonyl group, alkylsulfonyl group or arylsulfonyl group, and naphthalene ring in the formula (2) may have further substituents;

Formula (3)

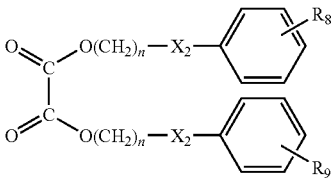

wherein, $R_8$ and $R_9$ are each independently hydrogen atom, halogen atom, alkyl group having 1-4 carbon atoms or alkoxyl group having 1-4 carbon atoms, $X_2$ is a single bond or —O—, n is an integer of 1 to 4;

Formula (4)

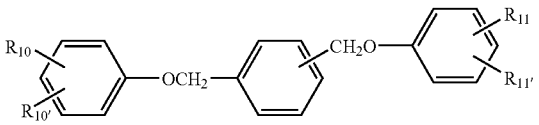

wherein, $R_{10}$, $R_{10'}$, $R_{11}$ and $R_{11'}$ are each independently hydrogen atom, halogen atom, alkyl group, aryl group, alkoxy group, alkylcarbonyl group, arylcarbonyl group, alkoxycarbonyl group or aryloxy group.

2. The heat-sensitive lithographic printing plate according to claim 1, wherein the image-forming layer does not substantially contain an inorganic pigment.

3. The heat-sensitive lithographic printing plate according to claim 1, wherein the thermoplastic resin is a self-crosslinking type synthetic rubber latex.

4. The heat-sensitive lithographic printing plate according to claim 1, wherein the image-forming layer contains at least one selected from the compound of formulae (1), (2) and (4).

5. The heat-sensitive lithographic printing plate according to claim 1, wherein the image-forming layer contains at least one selected from the compound of formulae (1) and (2).

6. The heat-sensitive lithographic printing plate according to claim 1, wherein the image-forming layer contains the compound of formulae (1).

7. The heat-sensitive lithographic printing plate according to claim 1, wherein an amount of the at least one selected from the compound of formulae (1), (2), (3) and (4) is 30 to 130% by weight based on an amount of the thermoplastic resin.

8. The heat-sensitive lithographic printing plate according to claim 3, wherein the self-crosslinking type synthetic rubber latex is carboxy-modified styrene-butadiene copolymer.

9. The heat-sensitive lithographic printing plate according to claim 1, wherein the water-soluble polymer compound is gelatin or polyvinyl alcohol and modified ones thereof.

10. The heat-sensitive lithographic printing plate according to claim 1, wherein the heat-sensitive lithographic printing plate is a direct heat-sensitive lithographic printing plate.

11. The heat-sensitive lithographic printing plate according to claim 10, wherein the image-forming layer is the uppermost layer.

12. The heat-sensitive lithographic printing plate according to claim 1, wherein the image-forming layer comprises the thermoplastic resin in an amount of 5 to 50% by weight based on the whole solid contents of the image-forming layer.

13. The heat-sensitive lithographic printing plate according to claim 1, wherein the image-forming layer comprises a curing agent.

* * * * *